US009736595B2

(12) United States Patent
Elyada

(10) Patent No.: US 9,736,595 B2
(45) Date of Patent: Aug. 15, 2017

(54) TWO PORT SPEAKER ACOUSTIC MODULATOR

(71) Applicant: DSP Group LTD., Herzeliya (IL)

(72) Inventor: Ori Elyada, Bnei Zion (IL)

(73) Assignee: DSP Group Ltd., Herzliya (IL)

( * ) Notice: Subject to any disclaimer, the term of this patent is extended or adjusted under 35 U.S.C. 154(b) by 0 days.

(21) Appl. No.: 15/190,218

(22) Filed: Jun. 23, 2016

(65) Prior Publication Data

US 2016/0381464 A1 Dec. 29, 2016

Related U.S. Application Data

(60) Provisional application No. 62/183,206, filed on Jun. 23, 2015.

(51) Int. Cl.

| | |
|---|---|
| ***H04R 19/00*** | (2006.01) |
| ***H04R 19/02*** | (2006.01) |
| *H04R 3/12* | (2006.01) |
| *H04R 1/22* | (2006.01) |
| *H04R 31/00* | (2006.01) |

(52) U.S. Cl.
CPC ..... *H04R 19/02* (2013.01); *H04R 1/22* (2013.01); *H04R 3/12* (2013.01); *H04R 31/00* (2013.01); *H04R 2217/03* (2013.01)

(58) Field of Classification Search
CPC ..... H04R 19/02; H04R 3/12; H04R 2217/03; H04R 1/22; H04R 31/00
See application file for complete search history.

(56) References Cited

U.S. PATENT DOCUMENTS

2009/0028356 A1* 1/2009 Ambrose ..... H04R 1/1091 381/71.6
2016/0088418 A1* 3/2016 Sato ..... G10K 11/346 381/17

* cited by examiner

*Primary Examiner* — Muhammad N Edun
(74) *Attorney, Agent, or Firm* — Reches Patents

(57) ABSTRACT

A two-port air pump speaker that includes at least two active, phase-modulated, bi-directional shutters and an ultrasonic pumping chamber having at least two ports; a first port facing towards the listener, the forward port, and a second port facing another direction, the backward port which may be behind an acoustic baffle or inside a speaker enclosure. A two-port speaker with two active steering shutters can create continuous bi-directional airflow which leads to low distortion reproduction of low audio frequencies. The same improved design can be used also for other applications where acoustic modulation is required, especially in ultrasonic frequencies.

35 Claims, 19 Drawing Sheets

1900

TWO PORT SPEAKER ACOUSTIC MODULATOR

CROSS REFERENCE TO RELATED APPLICATIONS

This application claims the benefit of U.S. provisional patent Ser. No. 62/183,206 filing date Jun. 23, 2015 which is incorporated herein by reference.

BACKGROUND OF THE DISCLOSURE

A speaker is a device that generates acoustic signals. A traditional speaker usually includes a moving membrane actuated (e.g. using electromagnetic actuation) by a signal in the Audio frequencies, representing the actual Audio signal that needs to be rendered by a speaker. The moving membrane then creates a local change in air pressure that is related to the audio signal. As a result of these local changes in air pressure an acoustic wave is generated and propagated through the air, thus reproducing the Audio signal used to actuate the membrane. For a given displacement d of a membrane of diameter D, the sound pressure of the wave generated scales with the frequency f as $(Ddf)^2$. (Principles of Vibration and Sound" by Thomas D. Rossing, Neville H. Fletcher, $2^{nd}$ ed., chapter 10.9 Loudspeakers.) Thus, the Sound Pressure Level (SPL) of such a speaker is decreased with frequency at a rate of 20 dB for drop in frequency by factor 10. Because of such scaling, a traditional speaker requires a large diaphragm and/or large displacement in order to produce low frequency sounds. This fundamental principle is a limitation on the design of small sized speakers, used in mobile devices, for example.

One design of small speakers for use in mobile devices is known as a micro-electromechanical system pico-speaker or "MEMS pico-speaker" and is described in the U.S. Pat. No. 8,861,752. The same scaling of sound pressure increasing with frequency to a power of two is used in the pico-speaker. As described in U.S. Pat. No. 8,861,752, a membrane is oscillated at an ultrasonic frequency that is modulated with the wanted audio signal. An acoustic shutter is then used to obstruct and open the air flow of the ultrasonic wave generated by the oscillating membrane, thus modulating this ultrasonic wave. Operating the shutter/modulator at ultrasonic frequency related to the central frequency used for the membrane can result in generating output air pressure in audio frequencies range, corresponding to the wanted audio signal.

Some embodiments of the present disclosure are generally related to improvements in the acoustic modulator used in a MEMS pico speaker, but the same embodiments may be used for other purposes, wherever acoustic modulation can be of use.

DESCRIPTION OF DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF THE DISCLOSURE

Figure 1:
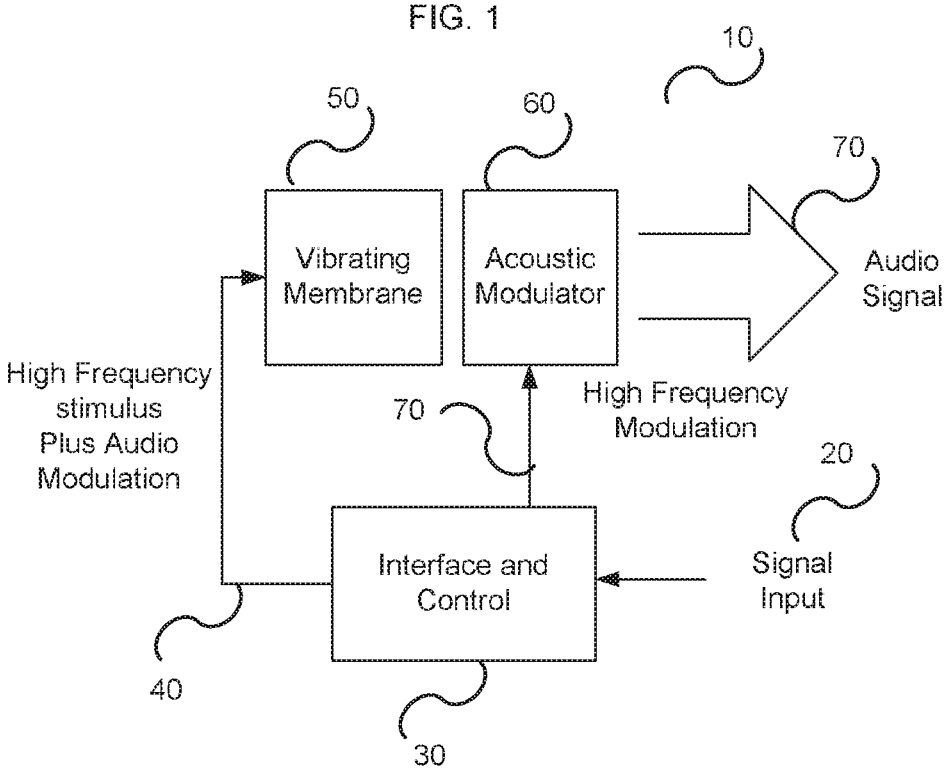
FIG. 1 is a block schematic diagram of an example prior art pico-speaker.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a device capable of executing the method.

Any reference in the specification to a device should be applied mutatis mutandis to a method that may be executed by the device.

The terms "membrane", "vibrating membrane", "pumping membrane" and "perforated membrane" are used in an interchangeable manner.

The term bling refers to a perforated element (such as but not limited a this sheet) that may be rigid.

First consider the following review of an example pico-speaker design so that differences with the proposed method can be elucidated. FIG. 1 is a block schematic diagram of an example pico-speaker 10. The audio signal input 20 is applied to the interface and control block 30. The interface and control block 20 generates two stimulus frequency signals 40 and 70. Frequency signal 40 is at an ultrasound frequency which is modulated by the audio input signal 20. A typical ultrasound frequency may be in the 50 to 500 KHz range. Frequency signal 40 is applied to the membrane 50. This causes the membrane to oscillate or vibrate in sympathy with the stimulus frequency 40. The ultrasonic wave resulting from the membrane vibrations is modulated by the acoustic modulator block 60. The action of the acoustic modulator 60 is to obstruct and open the air flow from the membrane 50. The stimulus signal 70 from the interface and control 30 is preferably at the same central ultrasonic frequency used to stimulate the membrane 40, but in this case it is not modulated by the audio signal. It can be shown that the resulting acoustic wave 70 can be made to have a strong component at the audio signal frequencies, corresponding to the Input Signal 20.

An identical result is obtained if the stimulus signal 70 is modulated by the audio signal input 20 while the frequency signal 40 driving the membrane 50 is driven at a constant unmodulated frequency. A combination of these options whereas both membrane and acoustic modulator blocks receive modulated inputs is also possible. For coherency of this disclosure, it is hereby assumed that only the membrane is modulated by the audio input while the acoustic modulator is driven at a constant frequency.

Because air pressure from a given membrane rises with frequency to the power of two, the performance of such a pico-speaker is that the reproduced low audio frequencies and hence the overall quality of the audio performance is improved over a conventional speaker design. The interface and control block generates the actuation voltages required in order to vibrate the membrane and the shutter. These actuation voltages depend on the specific type of the actuation scheme.

Figure 2:
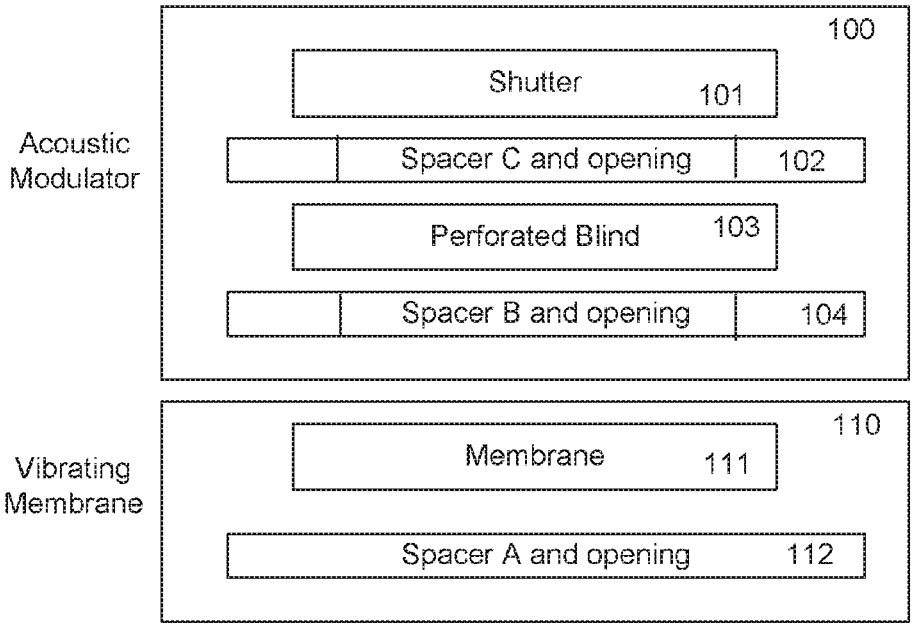
FIG. 2 is diagram of the mechanical construction of a pico-speaker as described in FIG. 1.

FIG. 2 is diagram of the mechanical construction of a pico-speaker as described in FIG. 1. The vibrating membrane 110 consists of two parts, the membrane 111 and a spacer 112. Spacer 112 mechanically supports the membrane and also allows the membrane to vibrate. The acoustic modulator 100 consists of four parts. Spacer 104 separates and supports the perforated blind 103. The blind 103 is a rigid sheet that has apertures in it to allow the flow of air resulting from the vibrating membrane. Spacer 104 separate the blind 103 from the membrane 111 so as to support the blind 103 but also to allow room for the membrane 111 to vibrate. Spacer 102 separates the blind 103 and the shutter 101 such that the shutter 101 is supported but can still vibrate. The action is that as the shutter 101 vibrates it opens and closes the apertures in the blind 103 such that the air flow from the membrane 111 is interrupted, and thus the air flow is modulated.

FIGS. 3A-3F provide examples of a MEMS pico-speaker mechanical design 250 together with example designs for the membrane 200, blind 210 and shutter 220. In this example the pico-speaker mechanical design is a small cylinder. The mechanical assembly is shown as a part cut away diagram for clarity. The speaker design consists of the membrane, blind and shutter as well as the three spacers as introduced in FIG. 2. The interface and control block, 30 as described in FIG. 1, is generally external to the mechanical speaker package.

Figure 3A:
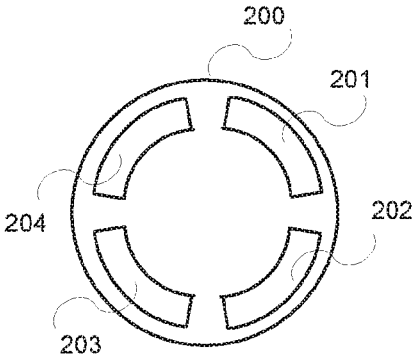
FIG. 3A is an example of the design of membrane.
Figure 3B:
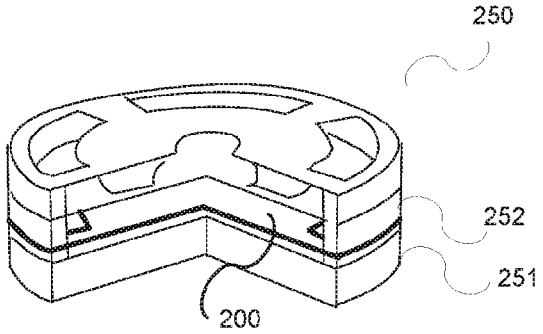
FIG. 3B is a sketch of the mechanical assembly of an example pico-speaker showing the membrane.

FIG. 3A is an example of the design of membrane 200. The membrane 200 is a circular design with four symmetrical apertures 201, 202, 203 and 204 situated at the edge of the membrane, suspended on springs 205, 206, 207 and 208. The four springs with the corresponding apertures facilitate the vibration of the membrane. FIG. 3B is a sketch of the mechanical assembly of an example pico-speaker showing the spacer 251 and above that the membrane 200. Above the membrane 200 is spacer 252. The membrane 200 is therefore sandwiched between the two spacers 251 and 252. Spacer 251 will typically consist of a base and an outer edge support for the membrane 200. Spacer 252 will typically be a ring that supports the out edge of the membrane 200 thus allowing the membrane to vibrate freely.

Figure 3C:
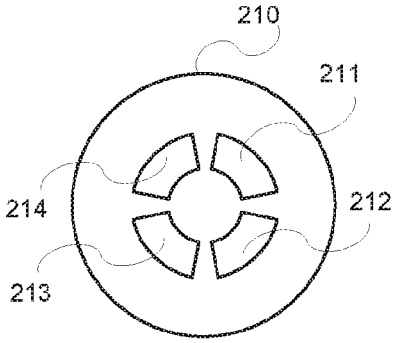
FIG. 3C is an example of the design of a blind.
Figure 3D:
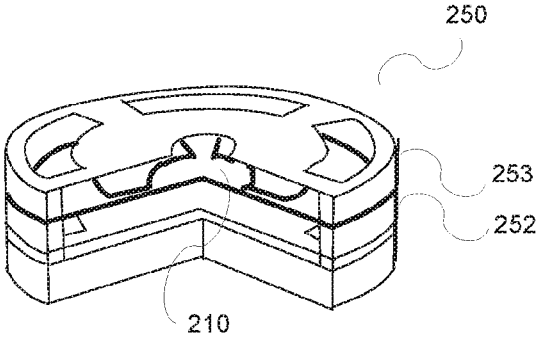
FIG. 3D is a sketch of the mechanical assembly of an example pico-speaker showing the blind.

FIG. 3C is an example of the design of a blind 210. The blind 200 is a circular design with four symmetrical apertures 211, 212, 213 and 214. The four apertures are located such that the air flow from the membrane vibrations can freely pass through the apertures. FIG. 3D is again the sketch of the mechanical assembly 250 of an example pico-speaker. The blind 210 is sandwiched between the two spacers 252 and 253 respectively. Spacers 252 and 253 will typically be of a ring design holding the blind firmly in place but allowing air to flow through the center. The blind is of a rigid construction.

Figure 3E:
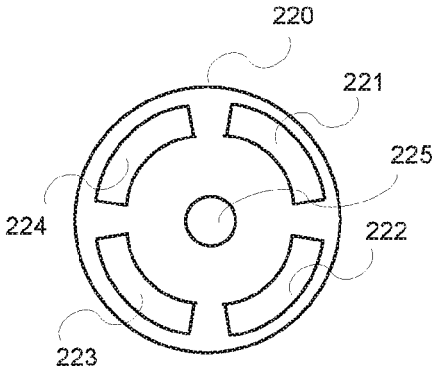
FIG. 3E is an example of the design of a shutter.
Figure 3F:
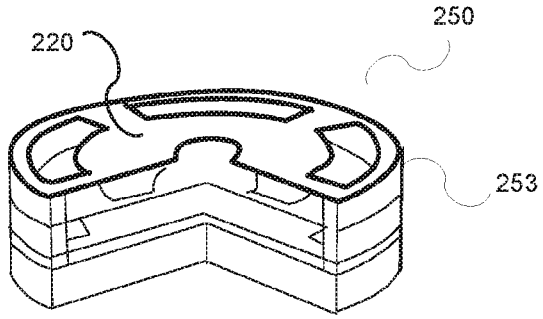
FIG. 3F is a sketch of the mechanical assembly of an example pico-speaker showing the shutter.

FIG. 3E is an example of the design of a shutter 220. The shutter 220 is a circular design with four symmetrical apertures 221, 222, 223 and 224 and four corresponding springs 225, 226, 227 and 228, which are at the outer edge and have the purpose of facilitating the vibration of the shutter. There is also a circular aperture 225 at the center of the shutter 220. It can be readily seen that if the shutter 220 is placed on top of the blind 210, then the apertures 211, 212, 213, and 214 of the blind 210 will be shut off. FIG. 3F is again the sketch of the mechanical assembly 250 of an example pico-speaker. The shutter 220 is supported by spacer 253.

Figure 4A:
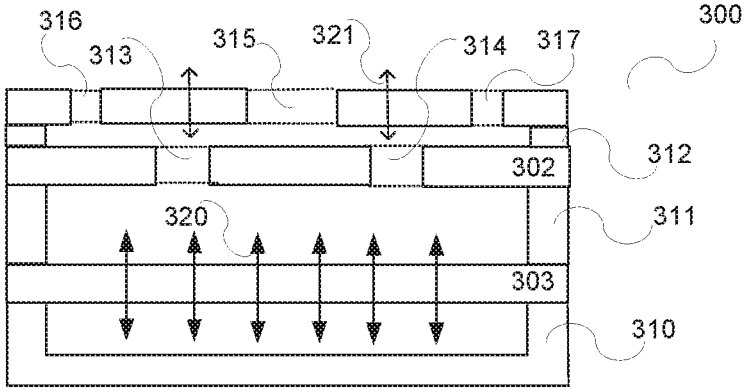
FIG. 4A is a cross section of the mechanical design of the MEMS pico-speaker when the shutter is in its neutral position.
Figure 4B:
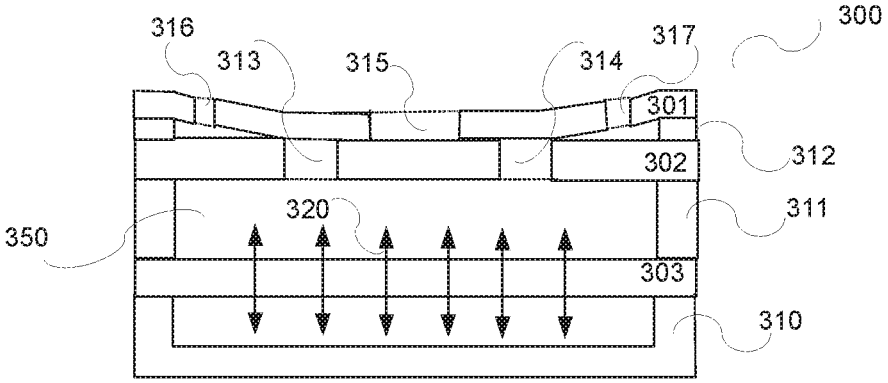
FIG. 4B is a cross section of the mechanical design of the MEMS pico-speaker when the shutter is caused to be depressed towards the blind.
Figure 4C:
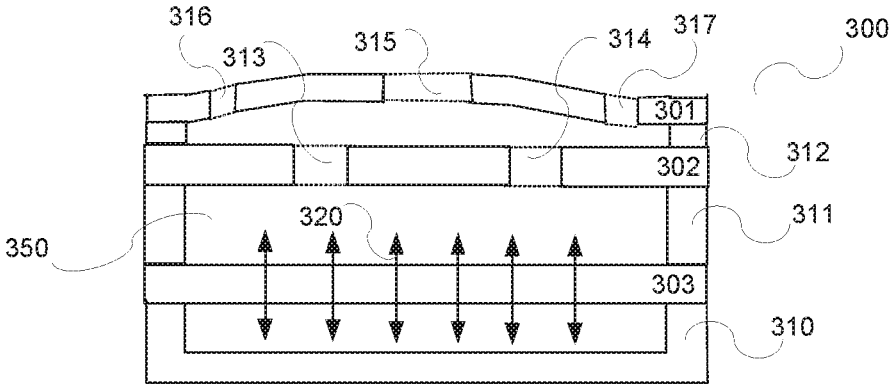
FIG. 4C is a cross section of the mechanical design of the MEMS pico-speaker when the shutter is caused to be moved away from the blind.

FIGS. 4A-4C are cross sections 300 of the mechanical design of the MEMS pico-speaker previously described. FIG. 4A represents the condition when the shutter 301 is in its neutral position. The membrane 303 is supported by spacer 310. The membrane is caused to vibrate 320 in the plane perpendicular to its mounting. The blind 302 is supported by spacer 311 and the shutter 301 is supported by spacer 312. Note that the apertures 313, 314 in the blind 302 and the apertures 315, 316 and 317 in the shutter 301 are such that they are not aligned with each other. FIG. 4B depicts the state when the shutter 301 is caused to be depressed towards the blind 302. The apertures 313 and 314 in the blind 302 are closed off by the shutter 301. FIG. 4C depicts the state when the shutter 301 is caused to be moved away from the blind 302. The apertures 313 and 314 in the blind 302 are now open and the air flow produced by the vibrating membrane 303 can escape via the apertures 313 and 314 in the blind 302 and the apertures 315, 316 and 317 in the shutter 301. Note that the apertures 313 and 314 shown in the blind 302 are representative of the four apertures 211, 212, 213, 214 in the blind 210 as shown in FIG. 3C. Similarly, the apertures 316 and 317 shown in the shutter 301 are representative of the four apertures 221, 222, 223 and 224 in the shutter 220 as shown in FIG. 3E and aperture 315 is representative of the central aperture 225 in FIG. 3E.

The acoustic modulator formed by the rigid perforated blind and the vibrating shutter cause the ultrasonic vibrations of the membrane to be converted to air flow vibrations that are at the required audio signal frequencies by producing the 'beat frequency' equal to the difference in frequency between the membrane frequency and the shutter frequency, and which is caused by the non-linear 'mixing'. As will be appreciated by one of skill in the art that the actual geometry of the apertures in the membrane, blind and shutter as shown in the figures can be varied and that the figures are for informative purposes only and are not to scale or intended to represent any particular practical design. The advantages of the design concepts as described herein are well documented. It will be pointed out, however, that the basic principle is that by vibrating the membrane at ultrasonic frequencies the resulting air pressure is much higher than could be established by the same membrane vibrating at audio frequencies. The action of the shutter and blind in modulating the ultrasonic wave results in the audio-frequency generation that has a flat sound pressure level (SPL) response across a wide audio frequency band.

Figure 5A:
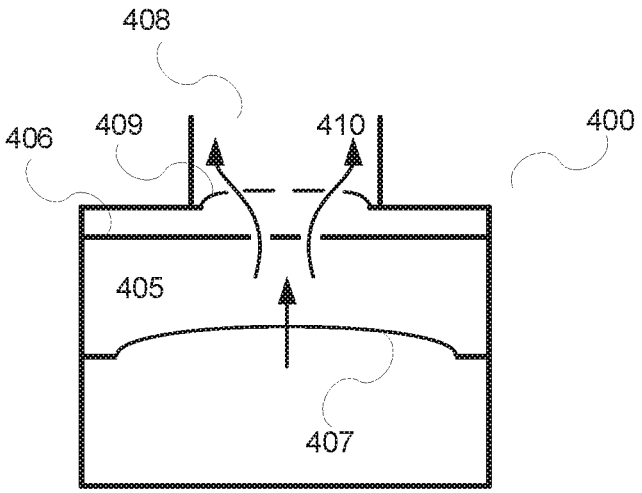
FIGS. 5A-5B are diagrammatic representation of a prior art MEMS pico speaker that has a single acoustic port.
Figure 5B:
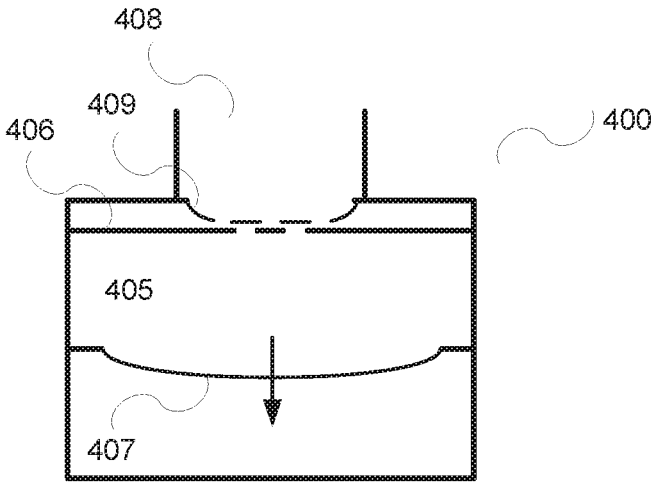

FIGS. 5A and 5B illustrate a diagrammatic simplification of a single-port pico speaker 400 as described in FIGS. 4A-4C. The membrane 407 oscillates perpendicular to its orientation and the shutter 409 opens and closes airflow 410 through blind 406 such that airflow through the acoustic port 408 is modulated. The frequencies and relative phase of the membrane 407 and the shutter 409 are controlled by an electronic circuit that modulates them in response to an audio input signal.

FIG. 5A shows one state of the device wherein the membrane 407 is moving towards the blind and the shutter 409 is open thus creating an outward airflow from the acoustic port 408.

FIG. 5B shows another state of the device wherein the membrane 407 is moving away from the shutter 409 and the shutter 409 is closed by the blind 406. In this state, there is no airflow through the acoustic port 408 at all and indeed no airflow anywhere in the device. The membrane movement merely affects the pressures in the device chambers. Note that there are additional device states that are not shown, namely an open shutter with membrane moving away from the shutter, a closed shutter with membrane moving towards the shutter and all intermediate shutter and membrane positions.

This configuration is lacking a second port and we claim that a two-port device is essential for efficient reproduction of audio frequencies from an ultrasonic membrane source. Consider, for example, a 1 Khz square wave audio tone generated by pico speaker 400 with membrane 407 oscillating at 100 KHz. To recreate a single audio wave period of 1 mS, the shutter 409 is open while the membrane is moving towards it, and closed when moving away, for 50 membrane cycles (0.5 mS); and then closed as the membrane 407 moves towards the shutter 409 and open while moving away for another 50 cycles (0.5 mS). Of the 100 membrane cycles in one audio wave, consider the first cycle during which some mass of air 410 exited the device through port 408 leaving behind a vacuum in chamber 405. This vacuum has no way of replenishing because as the membrane 407 moves away from the shutter 409, increasing the volume of chamber 405, port 408 is closed by shutter 409 and no air can ingress. During the second and subsequent cycles, speaker 400 is operating under increasing vacuum until no further air mass can be pushed out of port 408. The inverse occurs during the next 50 cycles wherein the internal pressure rises until no further air mass can be ingressed into port 408. This effect severely limits audio reproduction quality and SPL with the described device.

Figure 6A:
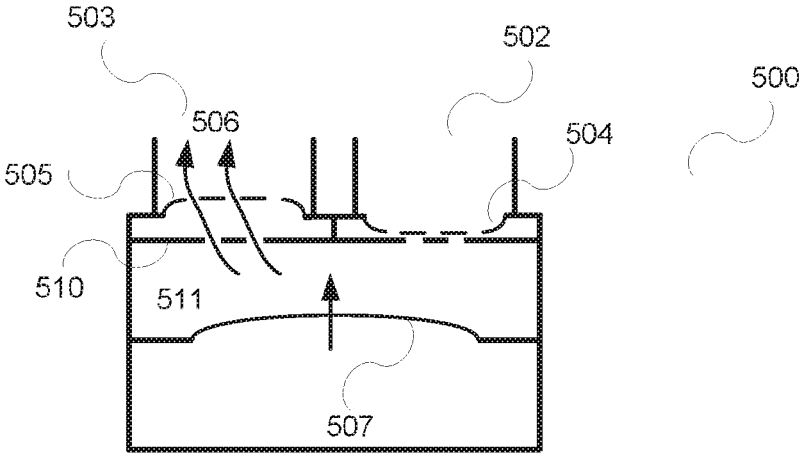
FIGS. 6A-6D are diagrammatic representation of an air pump speaker according to an embodiment of this disclosure.
Figure 6B:
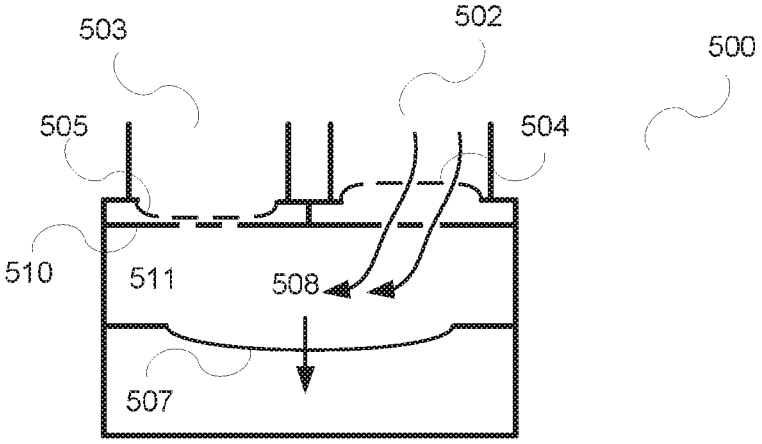

FIGS. 6A and 6B illustrate a modulated pump-speaker design 500 having two or more ports 502 and 503, each having a shutter 504 and 505 and a blind 510 acting to modulate the ultrasonic oscillations of the membrane 507. Port 503 generally faces the listener and will hereby be referred to as the forward port and port 502 will be referred to as the backward port.

Shutter 505 of the forward port 503 and shutter 504 of the backward port 502 operate out-of-phase such that when shutter 505 is open, shutter 504 is closed and vice versa and such that at any one time, excluding transitions, either shutter 505 or shutter 504 is open.

Consider again the example of the generation of a 1 KHz audio tone with a 100 KHz ultrasonic membrane. As exemplified in FIG. 6A, as membrane 507 moves towards the shutters 504 and 506, air 506 is expelled through open shutter 505 and out through forward port 503. In FIG. 6B, when the membrane direction reverses, shutter 505 is closed and shutter 504 is open ingressing air 508 through backward port 502 and releasing the vacuum in chamber 511. This operation essentially describes an air-pumping action hence the device is hereby termed a "pump-speaker".

By reversing the relative phase between the shutters and the pumping membrane, air can be expelled through the backward port and ingressed through the forward port. By alternating between these modes, an audio frequency wave can be recreated at the forward port and a second audio wave, in reverse polarity to the first, recreated at the backward port. This is equivalent to the operation of a conventional speaker which creates an acoustic wave in front of it and a reversed polarity acoustic wave behind it.

Instead of simply alternating between the two relative-phase modes, an audio input signal can be processed by an electronic circuit to continuously modulate the relative phase and/or the oscillation frequency and/or the amplitude of membrane and/or the shutters, resulting in generation of audio at the beat-frequency emitted from the forward port towards the listener.

The pump-speaker as described in FIGS. 6A-6D, is capable of delivering continuous airflow expelled from or ingressed into forward port 503, limited only by flow rate but, with appropriate modulation, capable of reproducing any audio frequency (including low frequencies) without limitations of displacement that hinder small conventional speakers and the prior art pico speaker.

Figure 6C:
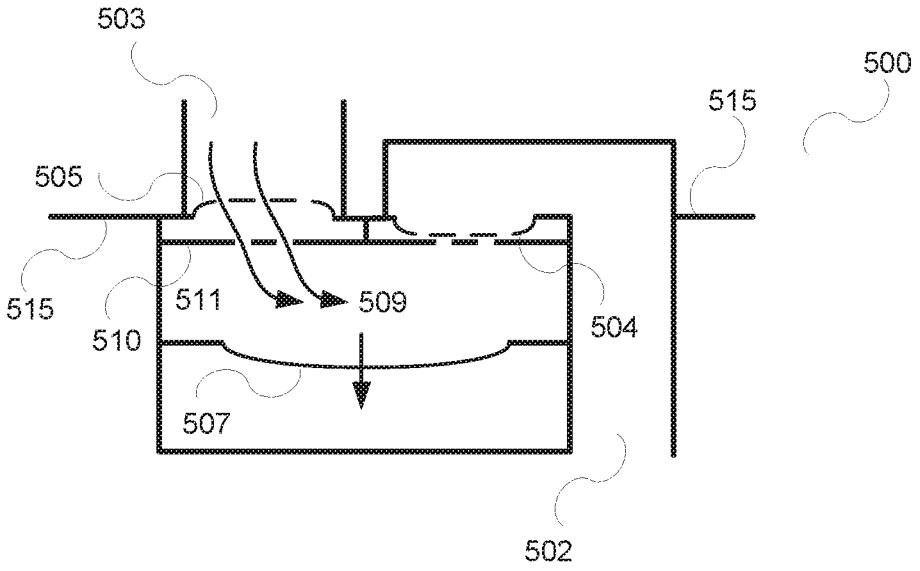

Similarly to a conventional speaker, in the pump-speaker it is also advantageous to direct the reversed polarity wave away from the listener otherwise it may interfere destructively with the intentional forward wave in a process known as "phase cancellation". One way to prevent phase cancellation, as shown in FIG. 6*c*, routes the backward port 502 to behind a baffle 515 which may be the face of a mobile device. In FIG. 6C, which illustrates a variation of the disclosure, membrane 507 is shown out of phase from shutter 505 thus ingressing air through forward port 503. Another way to prevent phase-cancellation disclosed in FIG. 6D, is to enclose the backward port 502 in a speaker enclosure 513, also known in the art as "back volume".

Figure 6D:
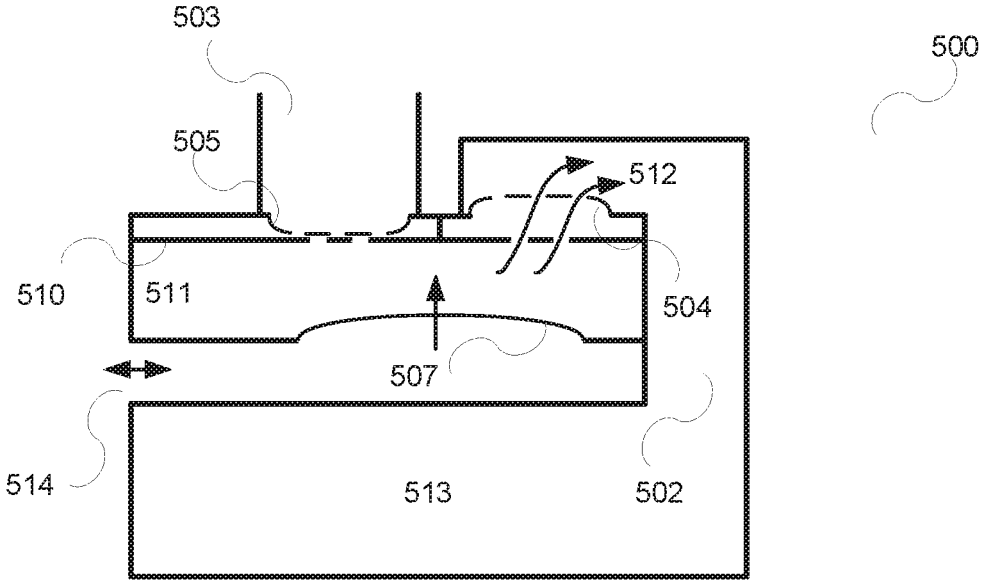

FIG. 6D shows the membrane 507 expelling air through shutter 512 into the back volume 513 through port 502 which is fully enclosed in this embodiment. Irrespective of this, FIG. 6D also shows a ventilated back-side of the membrane 507 through an additional ultrasonic port 514. Port 514 is ultrasonic and does not affect audio frequency reproduction.

An air pump speaker that can pump a large volume of air using a modulated bi-directional MEMS pump is disclosed. Such an air pump speaker may be designed to be reversible and pump in either direction by using active shutters that are synchronous or anti-synchronous to the pumping membrane. Such an air pump speaker may modulate the airflow amplitude and direction by modulating the relative phase, or beat frequency, the derivative of the phase, between the pumping membrane and the shutters.

A speaker that conforms to this disclosure comprises at least two active, phase-modulated, bi-directional shutters and an ultrasonic pumping chamber having at least two ports; a first port facing towards the listener, the forward port, and a second port facing another direction, the backward port which may be behind an acoustic baffle or inside a speaker enclosure. A two-port speaker with two active steering shutters can create airflow from the backward port and out through the forward port, or at other times, from the forward port (ingress) and out through the backwards port. This design is symmetrical and assists the generation of low distortion, low frequency audio. Additional ultrasonic ports may or may not be present, depending on the actual embodiment but this has no effect on the sonic acoustic reproduction. Multiple arrangements of shutters and ultrasonic chambers are possible and the device can be arrayed and/or clustered in a group. The backwards port may exit behind a baffle, such as a smartphone face, or into a speaker enclosure to provide back volume and to prevent phase cancellation between the two ports. The device is preferably symmetric, with identical flow rates forward and back to reduce distortion.

Figure 7A:
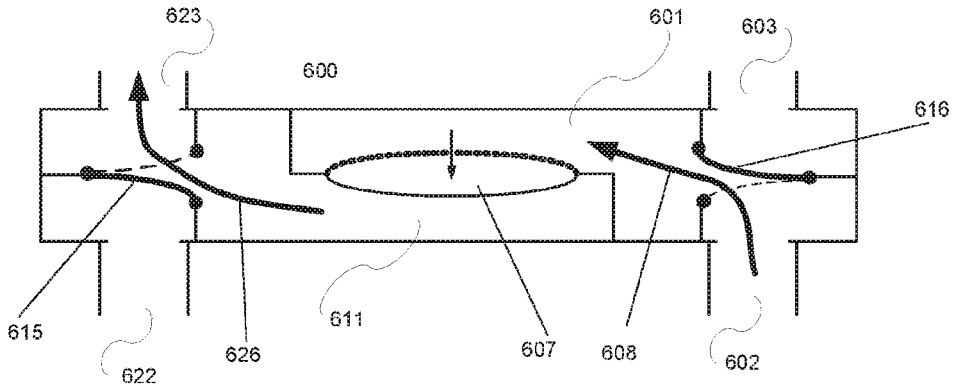
FIGS. 7A-7B is a diagrammatic representation of an air-pump speaker according to a further embodiment of the disclosure.
Figure 7B:
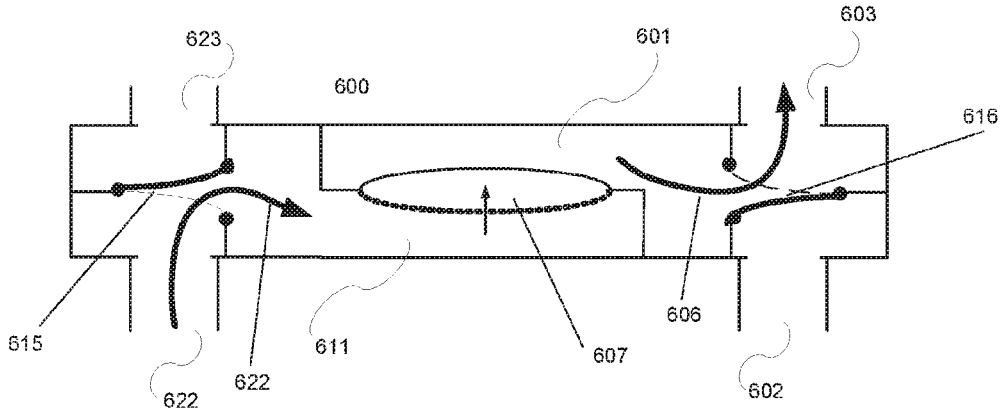

FIGS. 7A-7B provide a diagrammatic representation of a pump-speaker 600 according to a further embodiment of the disclosure. The speaker 600 comprises two chambers 601 and 611 with the vibrating membrane 607 located between them. Chamber 601 has a backward port 602 and a forward port 603 controlled by shutter 616 which is shown as a cantilever-like active steering shutter. Similarly chamber 611 has a backward port 622 and a forward port 623 controlled by shutter 615 which is also shown as a cantilever-like active steering shutter. The shutters 616 and 615 act in anti-phase to each other. As shown in FIG. 7A, when shutter 616 is closing the forward port 603 and opening the backward port 602 of chamber 601, shutter 615 is closing the backward port 622 and opening the forward port 623 of chamber 611. FIG. 7A illustrates a time when the pumping membrane is moving towards chamber 611. The air flow 608 is therefore into chamber 601 via backward port 602 and the airflow 626 is out of chamber 611 via forward port 623.

As shown in FIG. 7B, when shutter 616 is closing the backward port 602 and opening the forward port 603 of chamber 601, shutter 615 is closing the forward port 623 and opening the backward port 622 of chamber 611. In FIG. 7B the membrane is illustrated moving towards chamber 601. The air flow 606 is therefore out of chamber 601 via forward port 603 and the airflow 622 is into chamber 611 via inlet port 622.

Additional states of relative phase between the membrane and the shutters allow airflow to be reversed but are not shown. The embodiment as shown in FIGS. 7A-7B have the advantage that the sum of airflow from (or into) forward ports 603 and 623 has less ultrasonic content than the embodiment in FIG. 6 because either one or the other of the two ports is open on both strokes of the membrane so airflow is more continuous. An additional advantage of this embodiment is that all of the pumping energy generated by the membrane is used to generate the audio wave with no ultrasonic energy radiated such as in FIG. 6*d*.

Figure 8:
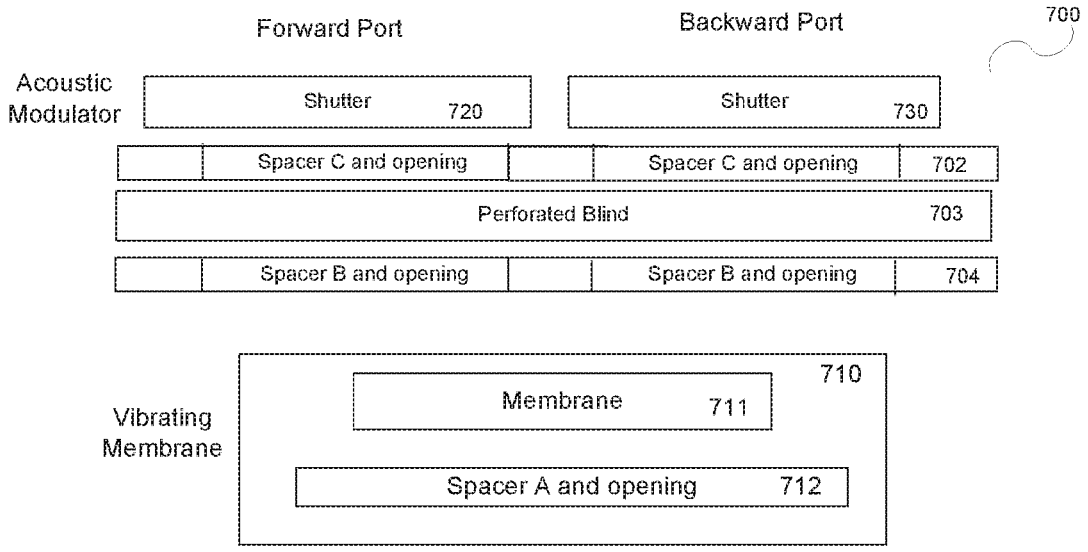
FIG. 8 is diagram of the mechanical construction of an air-pump speaker that represents an embodiment of this disclosure.

FIG. 8 is a diagram of the mechanical construction of a pump-speaker that represents an embodiment of this disclosure. The vibrating membrane 710 consists of two parts, the membrane 711 and a spacer 712. Spacer 712 mechanically supports the membrane and also allows the membrane to vibrate. The acoustic modulator 700 consists of five parts. Spacer 704 separates and supports the perforated blind 703. The blind 703 is a rigid sheet that has apertures in it to allow the flow of air resulting from the vibrating membrane. Spacer 704 separate the blind 703 from the membrane 711 so as to support the blind 703 but also to allow room for the membrane 711 to vibrate. Spacer 702 separates the blind 703 and the shutters 720 and 730 such that the shutter 701 is supported but can still vibrate. The action is that as the shutter 720 vibrates it opens and closes the apertures in the blind 103 such that the air flow from the membrane 111 is interrupted. Also as the shutter 730 vibrates it closes and opens the apertures in the blind 103 such that the air flow from the membrane 111 is interrupted, but in anti-phase to the action of the shutter 720. Shutter 720 opens and closes the forward port and shutter 730 closes and opens the backward port.

Additional auxiliary structures may be added to redirect the acoustic airflow from the ports to the required direction.

Figure 9:
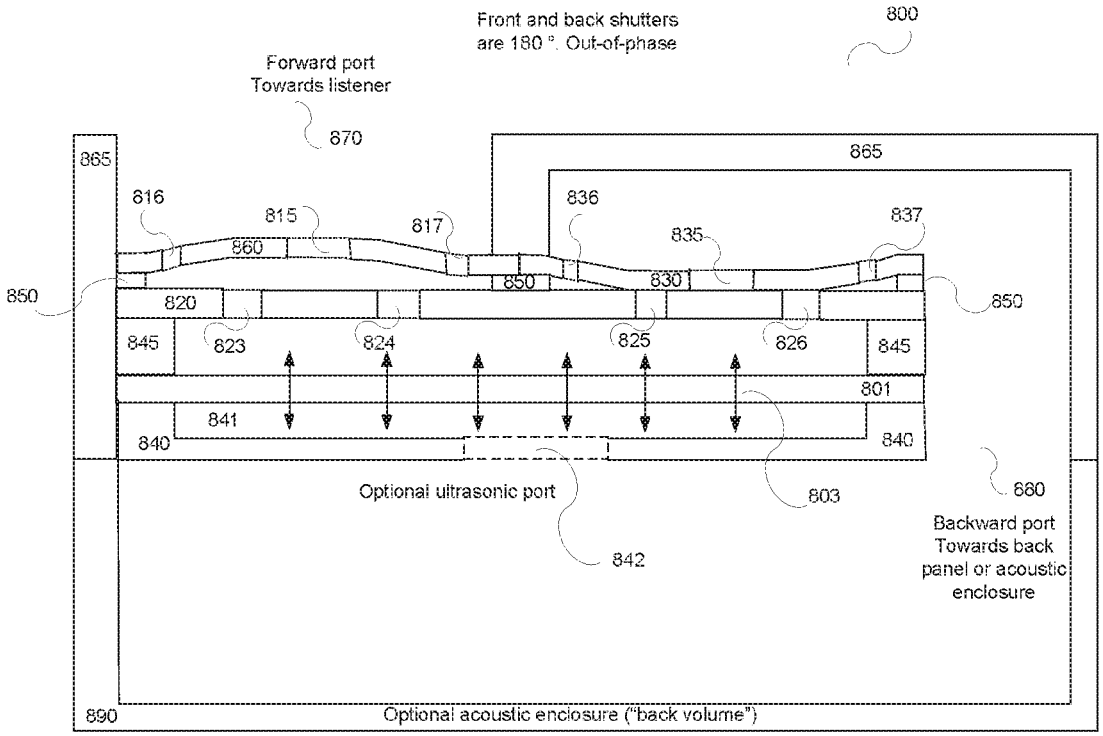
FIG. 9 is a cross section of the mechanical design of an air pump speaker that may represent the speaker previously described in FIG. 8.

FIG. 9 is a cross section 800 of the mechanical design of an MEMS pump-speaker that may represent the speaker previously described in FIG. 8 and in FIG. 6*d*. The construction of the pump-speaker may, but is not limited to, be of a circular or hexagonal or rectangular or square design.

FIG. 9 represents the condition when the forward port shutter 860 is in its open position and backward shutter 830 is in its closed position. The pumping membrane 801 is supported by spacer 840. The pumping membrane 801 is caused to vibrate 803 in the plane perpendicular to its mounting. The blind 820 is supported by spacer 845 and the shutters 830 and 860 are supported by spacer 850. Note that the apertures 825, 826 in the blind 820 and the apertures 836, 835 and 837 in the backward port shutter 860 are such that they are not aligned with each other. Hence apertures 825 and 826 in the blind 820 are closed off by the shutter 830 which is shown in its downward position. The apertures 823 and 824 in the blind 820 are open on the forward port because the forward port shutter 860 is shown in its upward position and the air flow produced by the vibrating membrane 803 can escape via the apertures 823 and 824 in the blind 820 and the apertures 816, 817 and 815 in the shutter 860 out towards the listener through the forward port 870. The shutters 830 and 860 move in anti-phase to each other such that in the next cycle of vibration shutter 830 will be in its upwards position, opening up the air flow to the backward port 880, and shutter 860 will be in the downward position, closing off the forward port 870. The backward port 880 may be surrounded by an acoustic enclosure 890 which creates a back volume and enhances the listener experience at the forward port 870 by preventing phase cancellation. Note that the design 800 has two effective ports: 870, the forward port, and 880 the backwards port.

The design 800 also embodies two anti-phase shutters, thus satisfying the requirement for this disclosure, as previously described, of two active, phase-modulated, bi-directional shutters and an ultrasonic pumping chamber having that has at least two ports; a first port facing towards the listener, the forward port, and a second port facing another direction.

Design 800 may also include an optional ultrasonic port 842 venting chamber 841 behind membrane 801 into the optional acoustic enclosure 890 or out to free air if the acoustic enclosure is not implemented. The ultrasonic port 842 is not an essential part of this disclosure.

Figure 10A:
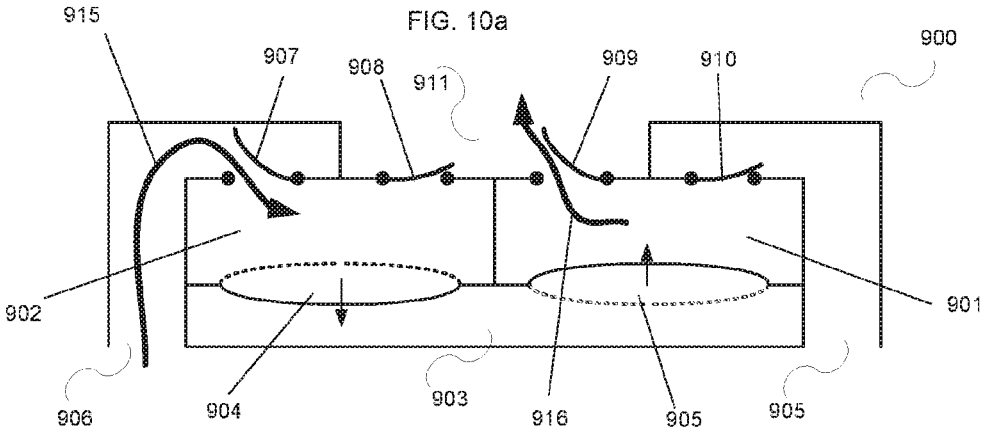
FIGS. 10A-10B are diagrammatic representations of yet another embodiment of this disclosure. The speaker comprises two anti-phase in-series ultrasonic chambers with corresponding vibrating membranes respectively together with a backward chamber.
Figure 10B:
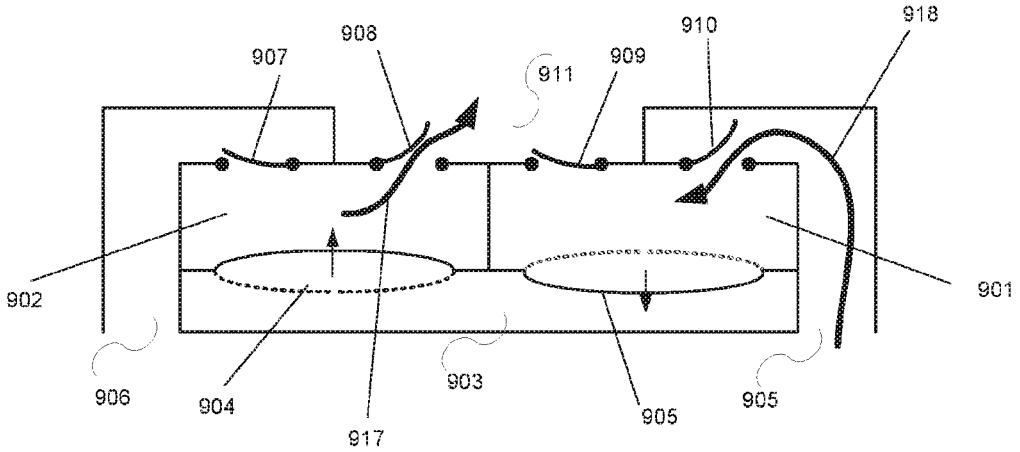

FIGS. 10A-10B are a diagrammatic representation of yet another embodiment of this disclosure. Speaker 900 comprises two anti-phase in-series ultrasonic chambers 901 and 902 with corresponding vibrating membranes 904 and 905 respectively together with a connecting ultrasonic chamber 903. There is a single forward port 911. Chamber 901 has a forward shutter 909 and a backward port 905 controlled by shutter 910. Chamber 902 has a forward shutter 908 and a backward port 906 controlled by shutter 907. The two membranes 904 and 905 vibrate in anti-phase. The two forward port shutters 908 and 909 also open and close in anti-phase as do the backward port shutters 907 and 910. Shutter 908 and 910 open and close in phase with each other and shutters 907 and 909 close and open in phase with each other. As shown in FIG. 10A, when the backward shutter 907 for chamber 902 is open, then the frontward shutter 908 for chamber 902 is closed. Hence the air flow 915 is from the backward port 906 into the chamber 902. At the same time, forward shutter 909 for chamber 901 is open and backward shutter 910 for chamber 901 is closed and hence the air flow 916 is out of chamber 901 through the forward port 911. The converse is shown in FIG. 10B. When the backward shutter 910 for chamber 901 is open, then the frontward shutter 909 for chamber 901 is closed. Hence the air flow 918 is from the backward port 905 into the chamber 901. At the same time, forward shutter 908 for chamber 902 is open and backward shutter 907 for chamber 902 is closed and hence the air flow 917 is out of chamber 902 through the forward port 911. By reversing the phase of the pumping membranes 904 and 905 in respect to the shutters, air is pumped in through forward port 911 and out through backward ports 905 and 906. The configuration represented by the speaker 900 is very symmetrical for flow rate in both directions and has identical positive and negative air pressures due to the condition that as one diaphragm pulls, the other pushes. Another advantage in this embodiment is that the audio airflow has less ultrasonic content compared to the embodiment illustrated in FIG. 6.

Figure 11:
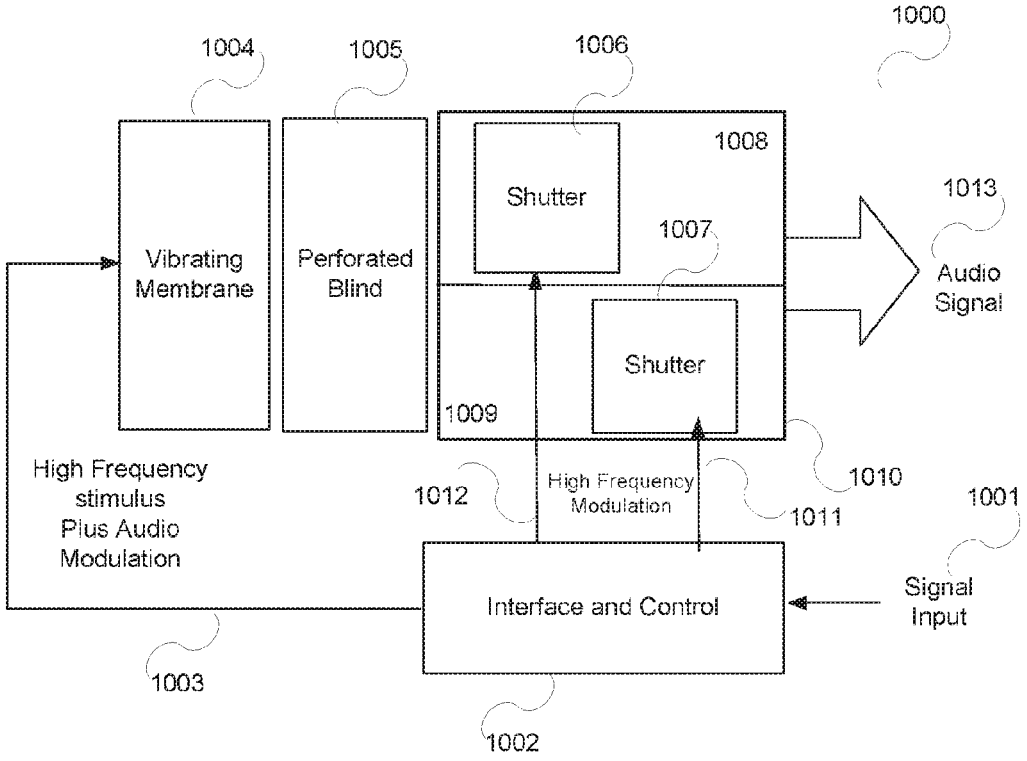
FIG. 11 is a block schematic diagram of speaker that conforms to an embodiment of the disclosure similar to that described in FIGS. 6A-6D, FIGS. 7A-7B, FIG. 8 and FIG. 9.

FIG. 11 is a block schematic diagram of speaker 1000 that conforms to an embodiment of the disclosure similar to that described in FIGS. 6A-6D, FIGS. 7A-7B, FIG. 8 and FIG. 9. The audio signal input 1001 is applied to the interface and control block 1002. The interface and control block 1002 generates three stimulus frequency signals 1003, 1012 and 1011. Stimulus signal 1003 is at an ultra sound frequency which is modulated by the audio input signal 1001. Stimulus signals 1012 and 1013 may be at the same ultrasonic frequency used to stimulate the membrane 1004, but in this case not modulated by the audio signal. Stimulus signal 1003 is applied to the membrane 1004. This causes the membrane to oscillate or vibrate in sympathy with the stimulus frequency 1003. The ultrasonic wave resulting from the membrane vibrations is passed to the perforated blind 1005 and together with the shutter block 1010. The shutter bock 1010 comprises two chambers 1008 and 1009. Chamber 1008 includes shutter 1006 and chamber 1009 includes shutter 1007. The stimulus signal 1012 is applied to shutter 1006 and stimulus signal 1011 is applied to shutter 1007. As previously described in FIGS. 6A-6D and FIGS. 7A-7B the action is that the shutters act in anti-phase to obstruct and open the air flow from the membrane 1004. The audio signal 1013, corresponding to the signal input 1001 is the result.

An identical result is obtained if the stimulus signals 1012 and 1011 are modulated by the audio signal input 1001 while the frequency stimulus 1003 driving the membrane 1004 is driven at a constant unmodulated frequency. A combination of these options whereas both the membrane and the acoustic modulator blocks receive modulated inputs is also possible.

The stimulus signals 1003, 1012 and 1011 may be in the form of a potential difference at ultrasonic frequency, so as to produce an electrostatic field that causes the blind 1005 and the shutters 1006 and 1007 to be attracted together or they may cause piezoelectric or magnetic actuation of the shutter and/or the membrane. Alternatively, the same potential difference may be implemented by feeding the two plates with signals that have opposite polarity, thus decreasing the amplitude needed for each signal.

It should be noted that the actual waveforms of the signals 1003, 1012 and 1011 may be harmonic, pulses of voltage, current or charge, digital or analog or any other periodic stimulus causing periodic actuation of the membrane and/or the shutters. In FIGS. 6A-6D and 10A-10B the shutters are shown diagrammatically. The shutters may comprise shutters acting together with a perforated blind as described in FIG. 2, FIGS. 3A-3F, FIGS. 4A-4C, FIGS. 5A-5B, FIGS. 6A-6D, FIG. 8 and FIG. 9 or they may be cantilever-shutter as described in FIGS. 7A-7B and FIGS. 10A-10B or any other conceivable air modulating means including, but not limited to, combs, sliding shutters, leafs, pistons, levers, gears or valves. The pumping membrane and the shutters can be actuated in different ways including, but not limited to, piezoelectric, magnetic and electrostatic actuation.

Figure 12:
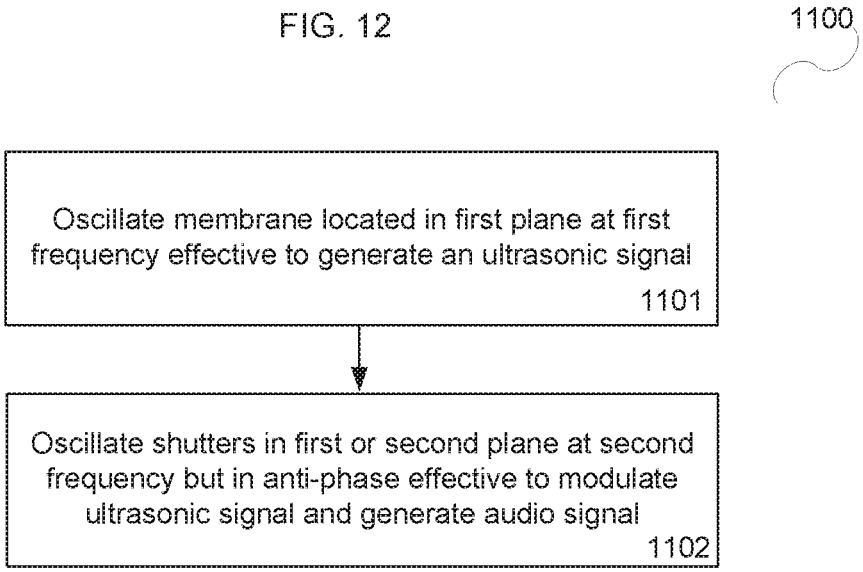
FIG. 12 illustrates method according to an embodiment of the disclosure.

FIG. 12 illustrates method 1100 according to an embodiment of the disclosure.

Method 1100 may start by stage 1101 where the membrane, which is located in the first plane, is caused to vibrate as the first frequency. The first frequency is an ultrasonic signal formed by modulating an ultrasonic frequency with the incoming audio signal. Stage 1101 may be followed by stage 1102 where the shutters are caused to oscillate in the same first plane as the membrane but in anti-phase to each other such that the ultrasonic vibrations produced by the membrane in stage 1101 are modulated to produce the wanted audio signal.

Figure 13:
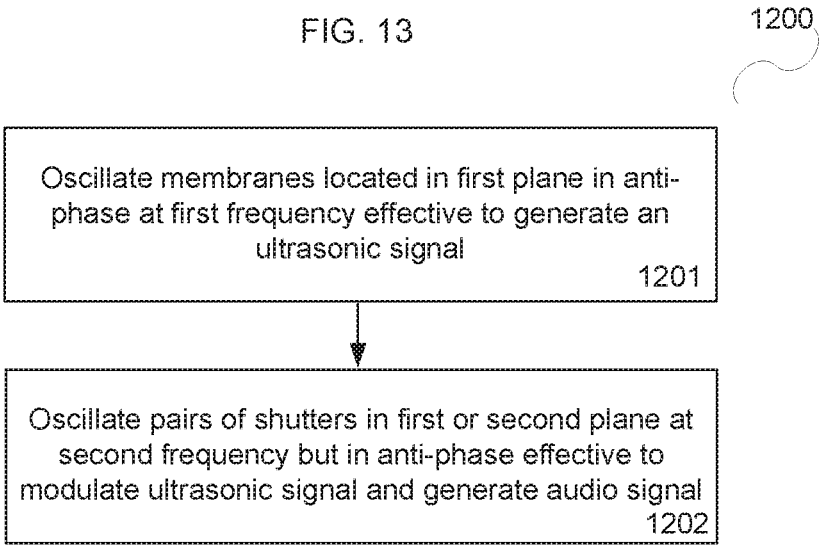
FIG. 13 illustrates method according to another embodiment of the disclosure.

FIG. 13 illustrates method 1200 according to another embodiment of the disclosure. Method 1200 may start by stage 1201 where the membranes, which are located in the first plane, are caused to vibrate at the first frequency in anti-phase to each other. The first frequency is an ultrasonic signal formed by modulating an ultrasonic frequency with the incoming audio signal. Stage 1201 may be followed by stage 1202 where pairs of shutters are caused to oscillate in the first plane or in a second plane as the membrane but in anti-phase to each other such that the ultrasonic vibrations produced by the membrane in stage 1201 are modulated to produce the wanted audio signal.

Figure 14:
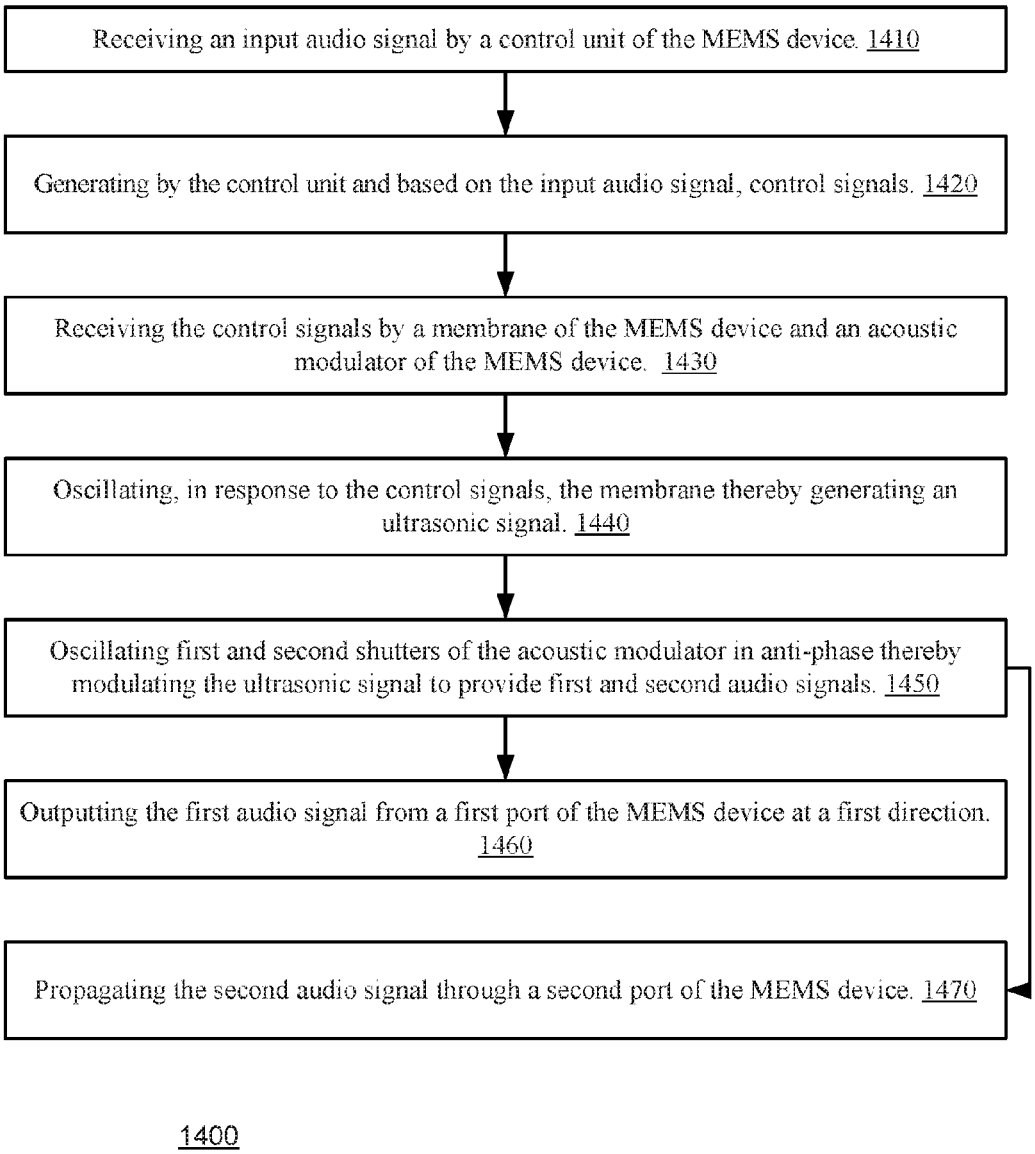
FIG. 14 illustrates method according to another embodiment of the disclosure.

FIG. 14 illustrates method 1400 according to an embodiment of the invention.

Method 1400 is for converting an input audio signal by a MEMS device.

Method 1400 may start by step 1410 of receiving an input audio signal by a control unit of the MEMS device.

Step 1410 may be followed by step 1420 of generating by the control unit and based on the input audio signal, control signals.

Step 1420 may be followed by step 1430 of receiving the control signals by a membrane of the MEMS device and an acoustic modulator of the MEMS device. Step 1430 may include receiving different control signals by the membrane and by the acoustic modulator.

Step 1430 may be followed by steps 1440 of oscillating, in response to the control signals, the membrane thereby generating an ultrasonic signal.

Step 1440 may be followed by step 1450 of oscillating first and second shutters of the acoustic modulator in anti-phase thereby modulating the ultrasonic signal to provide first and second audio signals.

Step 1450 may be followed by steps 1460 and 1470.

Step 1460 may include outputting the first audio signal from a first port of the MEMS device at a first direction.

Step 1470 may include propagating the second audio signal through a second port of the MEMS device.

The first points in time may correspond to a first part of one or more oscillation cycle of the first and second shutters and the second points in time may correspond to another part of the one or more oscillation cycles.

The input audio signal as well as the first and second audio signals may be generated during a period that includes a large number of oscillations.

The input audio signal may be an analog electrical signal that is not heard by a person while the first and second output audio signals can be heard by a person.

Figure 15:
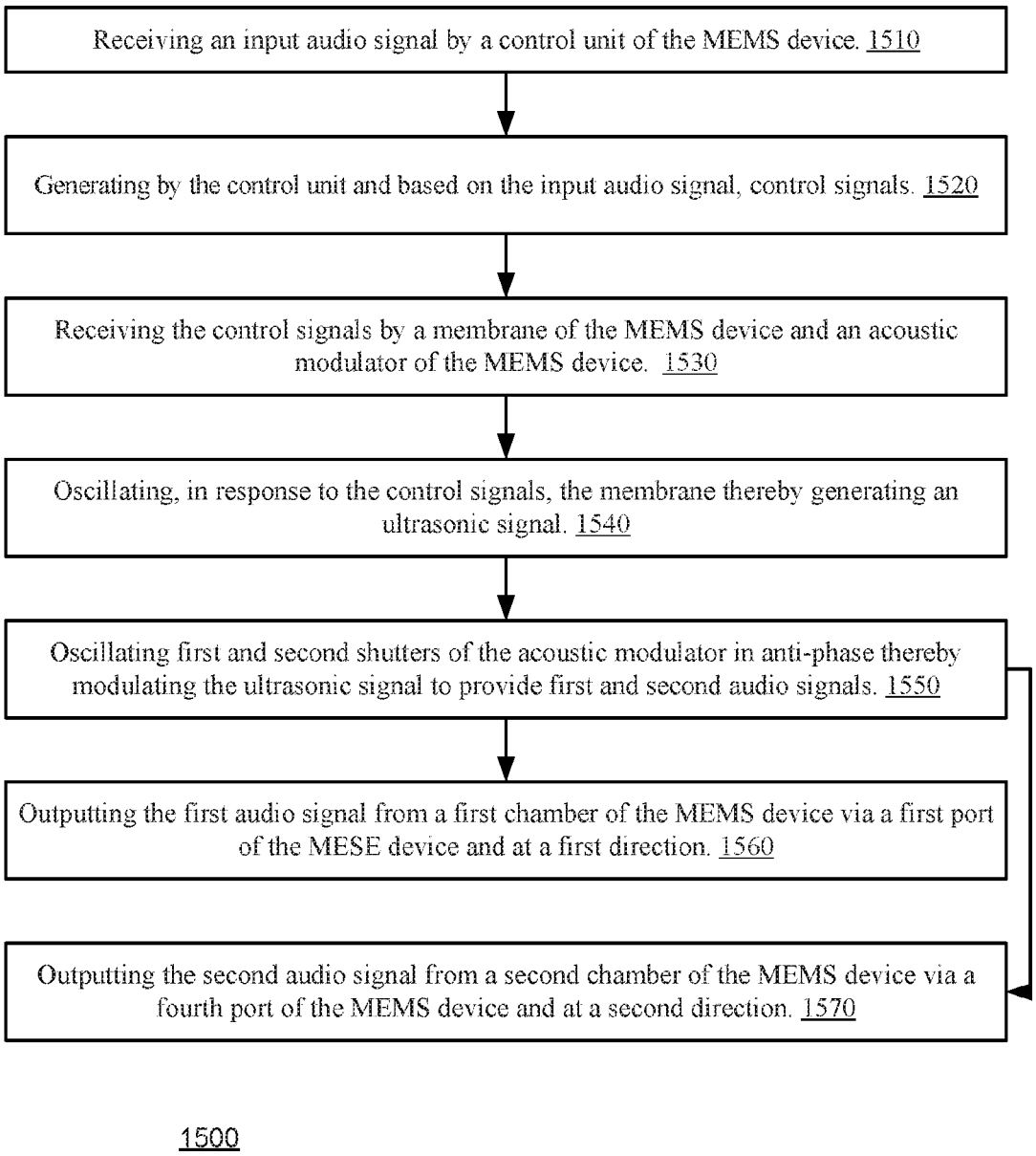
FIG. 15 illustrates method according to another embodiment of the disclosure.

FIG. 15 illustrates method 1500 according to an embodiment of the invention.

Method 1500 is for converting an input audio signal by a MEMS device.

Method 1500 may start by step 1510 of receiving an input audio signal by a control unit of the MEMS device.

Step 1510 may be followed by step 1520 of generating by the control unit and based on the input audio signal, control signals.

Step 1520 may be followed by step 1530 of receiving the control signals by a membrane of the MEMS device and an acoustic modulator of the MEMS device. Step 1530 may include receiving different control signals by the membrane and by the acoustic modulator.

Step 1530 may be followed by step 1540 of oscillating, in response to the control signals, the membrane thereby generating an ultrasonic signal.

Step 1540 may be followed by step 1550 of oscillating first and second shutters of the acoustic modulator in anti-phase thereby modulating the ultrasonic signal to provide first and second audio signals.

Step 1550 may be followed by steps 1560 and 1570.

Step 1560 may include outputting the first audio signal from a first chamber of the MEMS device via a first port of the MESE device and at a first direction.

Step 1570 may include outputting the second audio signal from a second chamber of the MEMS device via a fourth port of the MEMS device and at a second direction; and wherein the first points in time differ from the second points in time.

Figure 16:
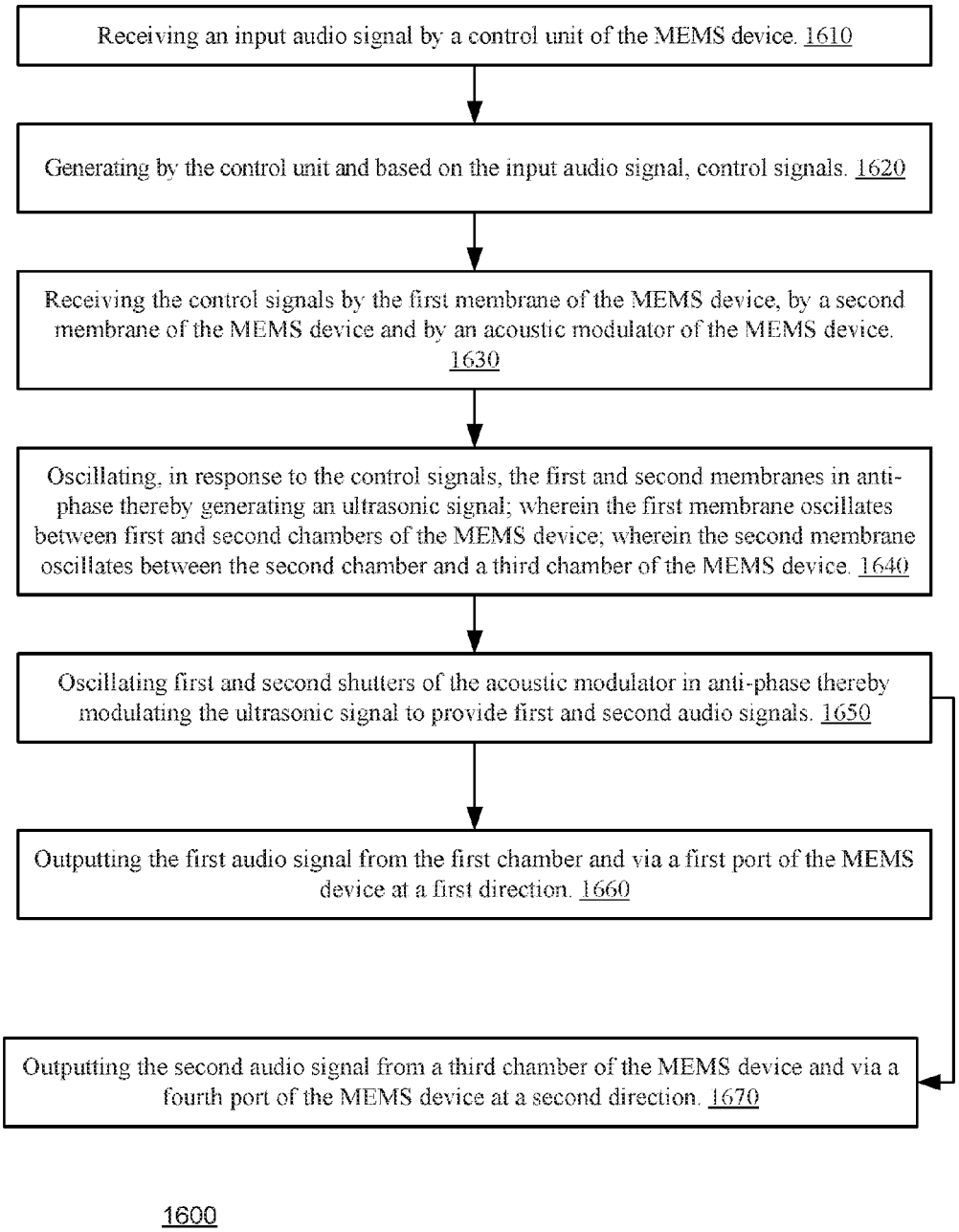
FIG. 16 illustrates method according to another embodiment of the disclosure.

FIG. 16 illustrates method 1600 according to an embodiment of the invention.

Method 1600 is for converting an input audio signal by a MEMS device.

Method 1600 may start by step 1610 of receiving an input audio signal by a control unit of the MEMS device.

Step 1610 may be followed by step 1620 of generating by the control unit and based on the input audio signal, control signals.

Step 1620 may be followed by step 1630 of receiving the control signals by the first membrane of the MEMS device, by a second membrane of the MEMS device and by an acoustic modulator of the MEMS device.

Step 1630 may be followed by step 1640 of oscillating, in response to the control signals, the first and second membranes in anti-phase thereby generating an ultrasonic signal; wherein the first membrane oscillates between first and second chambers of the MEMS device; wherein the second membrane oscillates between the second chamber and a third chamber of the MEMS device.

Step 1430 may be followed by step 1650 of oscillating, in response to the control signals, first and fourth shutters of the MEMS device in anti-phase in relation to second and third shutters of the MEMS device thereby modulating the ultrasonic signal to provide a first audio signal and a second audio signal.

Step 1650 may be followed by steps 1660 and 1670.

Step 1660 may include outputting the first audio signal from the first chamber and via a first port of the MEMS device at a first direction.

Step 1670 may include outputting the second audio signal at second points in time, from a third chamber of the MEMS device and via a fourth port of the MEMS device at a second direction; and wherein the first points in time differ from the second points in time.

According to an embodiment of the invention there may be provided a MEMS device that may include (see for example FIGS. 6A-6D) a membrane (507, 50), a chamber (511) that at least partially surrounds the membrane, an acoustic modulator that includes a blind (510), a first shutter (505) and a second shutter (504), a first port (503), a second port (502), and a control unit (590). The control unit may be configured to receive an input audio signal and based on the input audio signal, generate control signals that once supplied to the membrane and the acoustic modulator (i) cause the membrane to oscillate thereby generating an ultrasonic signal; and cause the first and second shutters to oscillate in anti-phase thereby modulating the ultrasonic signal to provide first and second audio signals; wherein the first audio signal (see air 506 in FIG. 6*a*) is outputted from the first port at a first direction. Wherein the second audio signal (see air 512 in FIG. 6D) propagates through the second port.

According to an embodiment of the invention the second port is preceded by a conduit (515 that is configured to prevent the second audio signal from being outputted at the first direction.

According to an embodiment of the invention there may be provided a MEMS device that may include (see for example FIGS. 7A-7B) a first chamber (601); a second chamber (611); a membrane (607, 50) is partially surrounded by the first chamber and is partially surrounded by the second chamber; an acoustic modulator that may include a first shutter (615) and a second shutter (608); a first port (623), a second port (622), a third port (603), a fourth port (602), and a control unit (690). The control unit is configured to: receive an input audio signal and based on the input audio signal, generate control signals that once supplied to the membrane and the acoustic modulator that (i) cause the membrane to oscillate thereby generating an ultrasonic signal; and (ii) cause the first and second shutters to oscillate in anti-phase thereby modulating the ultrasonic signal to provide (a) a first audio signal (see 626 of FIG. 7A) that is outputted from the first chamber via first port at a first direction; (b) a second audio signal (see 606 of FIG. 7B) that is outputted, at the second points in time, from the second chamber via the fourth port at a second direction. The first points in time differ from the second points in time.

According to an embodiment of the invention there may be provided a MEMS device that may include (see for example FIGS. 10A-10B) a first chamber (902), a second chamber (903), a third chamber (901), a first membrane (904), a second membrane (905), an acoustic modulator that may include a first shutter (908), a second shutter (909), a third shutter (907) and a fourth shutter (910), a first port (911), a second port (906), a third port (905) and a control unit (990). The control unit is configured to: receive an input audio signal; and based on the input audio signal, generate control signals that once supplied to the acoustic modulator and to the first and second membranes (i) cause the first and second membranes to oscillate in anti-phase thereby generating an ultrasonic signal; wherein the first membrane oscillates between the first and second chambers; the second membrane oscillates between the second and third chambers; and (ii) cause the first and fourth shutters to oscillate in anti-phase in relation to the second and third shutters thereby modulating the ultrasonic signal to provide (a) a first audio signal that is outputted from the first chamber and via the first port at a first direction (see 917 of FIG. 10*b*), (b) a second audio signal that is outputted at the second points in time, from the third chamber and via the first port at a second direction (see 916 of FIG. 10A). Wherein the first points in time differ from the second points in time.

Figure 17:
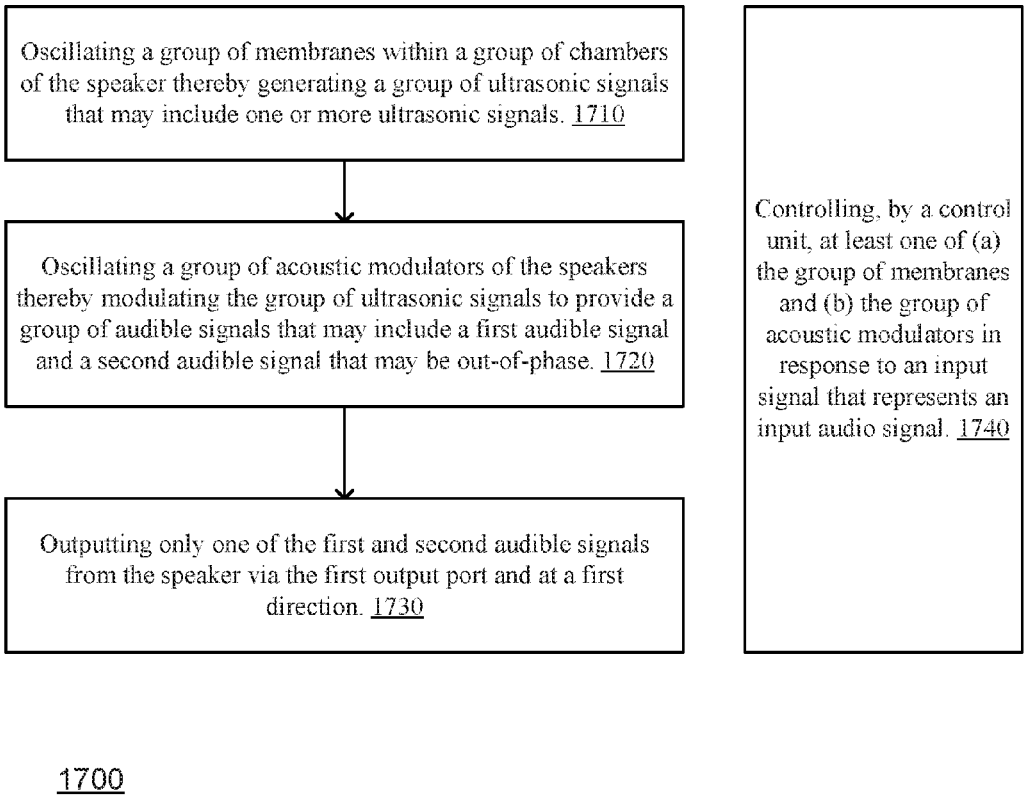
FIG. 17 illustrates method according to another embodiment of the disclosure.

FIG. 17 illustrates method 1700 according to an embodiment of the invention.

Method 1700 may be executed by any of the speakers illustrates in this specification and/or drawing.

Method 1700 is for activating a speaker.

Method 1700 may start by sequence of steps 1710, 1720 and 1730. The sequence may be executed in parallel to step 1740.

Step 1710 of oscillating a group of membranes within a group of chambers of the speaker thereby generating a group of ultrasonic signals that may include one or more ultrasonic signals.

Step 1720 of oscillating a group of acoustic modulators of the speakers thereby modulating the group of ultrasonic signals to provide a group of audible signals that may include a first audible signal and a second audible signal that may be out-of-phase.

Step 1730 of outputting only one of the first and second audible signals from the speaker via the first output port and at a first direction. The first audible signal may be outputted while the second audible signal is not outputted or vice versa. The first and second audible signals may be outputted in a non-overlapping manner or a partially overlapping manner.

Step 1740 of controlling, by a control unit, at least one of (a) the group of membranes and (b) the group of acoustic modulators in response to an input signal that represents an input audio signal.

The group of membranes may include one or more membranes, the group of acoustic modulators may include one or more acoustic modulators and the group of chambers may include one or more chambers.

The first and second audible signals may be in anti-phase.

The first and second audible signals may be out-of-phase by at least 30 degrees.

The speaker may be a micro-electromechanical system (MEMS) speaker.

The first acoustic modulator of the group of acoustic modulators may include a blind and a shutter. Method 1700 may include oscillating the shutter in relation to the blind thereby controlling a flow of air through the blind.

The first acoustic modulator of the group of acoustic modulators may include a shutter but does not include a blind.

Method 1700 may include controlling the group of membranes and the group of acoustic modulators in response to the input signal.

Method 1700 may include controlling the group of membranes in response to the input signal and controlling the group of acoustic modulators regardless of the input signal that represents the input signal.

Method 1700 may include controlling the group of acoustic modulators in response to the input signal and controlling the group of membranes regardless of the input signal.

The group of acoustic modulators and the group of membranes may be positioned at a same plane.

The first acoustic modulator of the group of acoustic modulators and a first membrane of the group of membranes may be positioned at a same plane.

The first acoustic modulator of the group of acoustic modulators and a first membrane of the group of membranes may be positioned at different planes.

The first acoustic modulator of the group of acoustic modulators and a first membrane of the group of membranes may be positioned at a same plane; and wherein a second acoustic modulator of the group of acoustic modulators and a second membrane of the group of membranes may be positioned at different planes.

The speaker may include a second port. Method 1700 may include outputting the first audible signal via the first port while outputting the second audible signal via the second port at a second direction that differs from the first direction.

The first and second directions may be opposite to each other.

The first and second directions may be oriented to each other by an angle that ranges between 60 and 300 degrees, or between 90 and 270 or between any sub-range between 90 and 270. In various examples the first and second directions are oriented by 180 degrees—but this is only an example. The first and second directions may differ from each other so that when a user is in front of the speaker he hears one audible signal and does not hear the second audible signal.

Method 1700 may include outputting the first audible signal via the first port while directing the second audible signal into an internal space of the speaker.

The first acoustic modulator of the group of acoustic modulators may include a single shutter.

The speaker may include a second port; wherein the group of membranes may include a first membrane and wherein the group of chambers may include a first chamber that at least partially surrounds the first membrane; wherein the group of acoustic modulators may include a first shutter, a second shutter, a first blind and a second blind. Method 1700 may include oscillating the first and second shutters out-of-phase; outputting the first audible signal from the first port at the first direction; and wherein the second audio signal propagates through the second port.

Method 1700 may include preventing, by a conduit that precedes the second port, the second audio signal from being outputted at the first direction.

The first and second shutters may be positioned at different planes.

The first and second shutters may be positioned at the same plane.

The first membrane may be fully surrounded by the first chamber.

The first membrane may be only partially surrounded by the first chamber.

The speaker may include an additional port, wherein the group of chambers may include a first chamber and a second chamber. Method 1700 may include oscillating the first membrane between the first chamber and the second chamber to provide a first ultrasonic signal of the group of ultrasonic signals, oscillating the first and second shutters out-of-phase thereby providing the first audible signal and the second audible signal; outputting the first audible signal from the first chamber via the first port at the first direction and outputting the second audible signal from the second chamber via the additional port at a second direction.

The speaker comprise a second port and a third port; wherein the first and third ports may be opposite to the second and additional ports. Method 1700 may include oscillating the first shutter between (a) a first position in which the first shutter facilitates a passage of the first audible signal towards the first port while preventing the propagation of the first audible signal towards the second port and (b) a second position in which the first shutter facilitates a propagation of the first audible signal towards the second port while preventing the propagation of the first audible signal towards the first port.

The membrane, the first shutter and the second shutter may be positioned at a same plane.

The speaker may include a second port, a third port and a fourth port; wherein the group of chambers may include a first chamber, a second chamber and a third chamber; wherein the group of membranes may include a first membrane and a second membrane; wherein the group of acoustic modulators may include a first shutter, a second shutter, a third shutter and a fourth shutter. Method 1700 may include oscillating the first and second membranes out-of-phase thereby generating a first ultrasonic signal of the group of ultrasonic signals; wherein the first membrane oscillates between the first and second chambers; wherein the second membrane oscillates between the second and third chambers; oscillating the first and fourth shutters out-of-phase in relation to the second and third shutters thereby modulating the first ultrasonic signal, outputting the first audible signal from the first chamber and via the first port at the first direction and outputting the second audible signal from the third chamber and via the fourth port at a second direction.

The first, second, third and fourth shutters may be positioned at a same plane.

The third shutter may be configured to input air via the third port and into the first chamber and wherein the fourth shutter may be configured to input air via the fourth ports.

The first and second ports may be opposite to the third and fourth ports.

The at least two shutters of the first, second, third and fourth shutters may be positioned at different planes.

Figure 18:
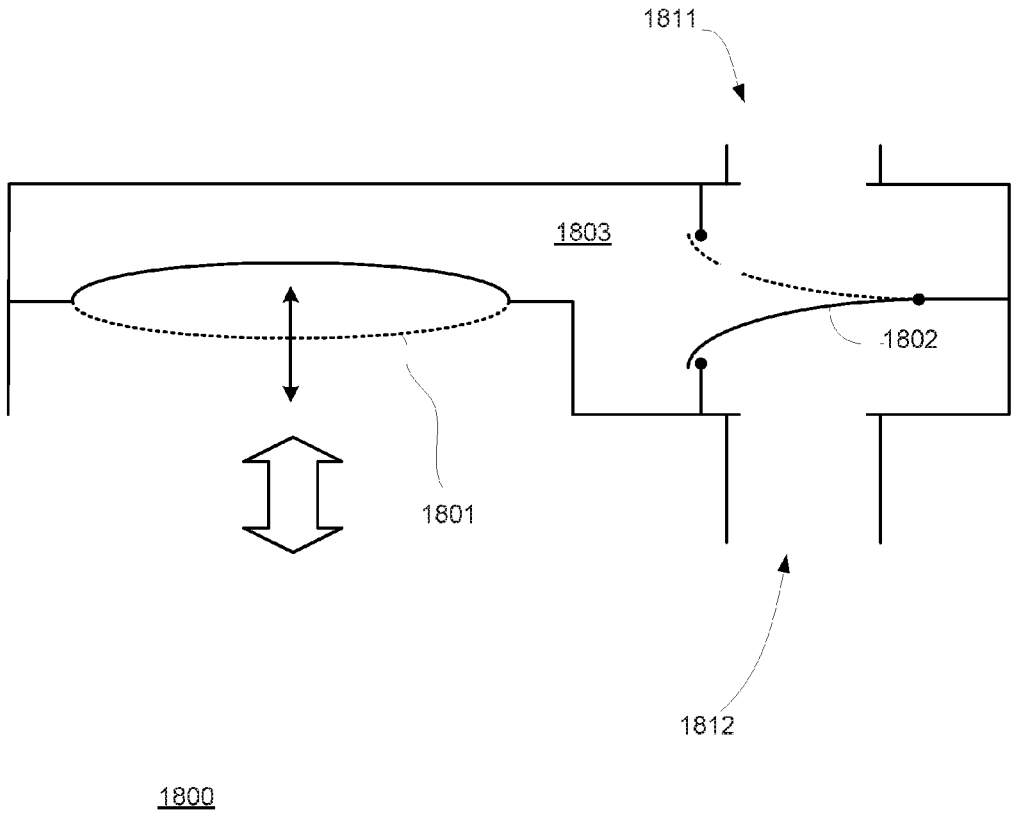
FIG. 18 is a diagrammatic representation of an air-pump speaker according to an embodiment of the disclosure.

FIG. 18 illustrates a speaker 1800 according to an embodiment of the invention.

The speaker 1800 includes a single membrane 1801 that may oscillate in and outside a first chamber 1803 to generate an ultrasonic signal. First chamber 1803 includes a forward port 1811 and a backward port 1812. Shutter 1802 may oscillate between a first position in which it blocks the forward port without blocking the backward port and a second position in which it blocks the backward port without blocking the forward port.

Figure 19:
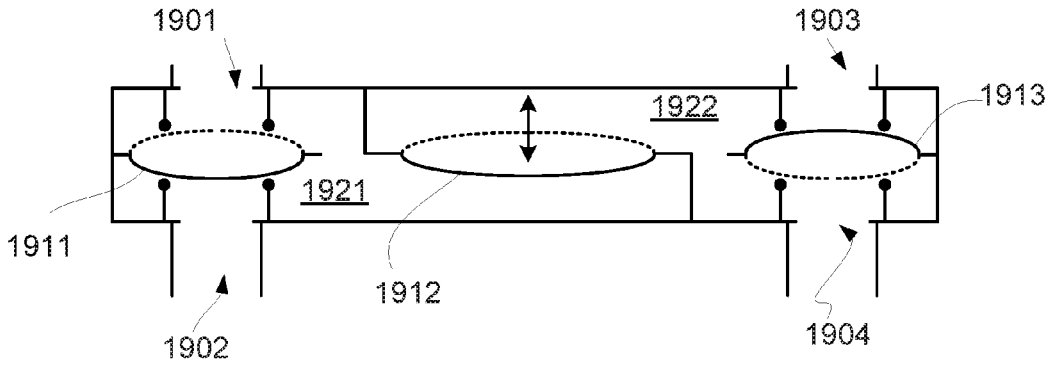
FIG. 19 is a diagrammatic representation of an air-pump speaker according to an embodiment of the disclosure.

FIG. 19 illustrates a speaker 1900 according to an embodiment of the invention.

The speaker 1900 includes a first membrane 1912 that oscillates between first chamber 1921 and second chamber 1922 to generate an ultrasonic signal. First chamber 1921 includes forward port 1901 and backward port 1902. Second chamber 1922 includes forward port 1903 and backward port 1904.

Speaker 1900 also includes two membranes 1911 and 1913 that act as shutters or valves.

Membrane 1911 may oscillate between a first position in which it blocks the forward port 1901 without blocking the backward port 1902 and a second position in which it blocks the backward port 1902 without blocking the forward port 1901.

Membrane 1913 may oscillate between a first position in which it blocks the forward port 1903 without blocking the backward port 1904 and a second position in which it blocks the backward port 1904 without blocking the forward port 1903.

The phrases "forward port", "backward port", "first port", "second port", "third port", "fourth port" and "additional port" may be used in an interchangeable manner.

Any reference to a membrane may be replaced by a reference to a source of an ultrasonic signal. For example—the membrane may be replaced by a piezoelectric stack.

A non-limiting example of the radius of the membrane may be between one micron and one centimeter. Other sizes may be provided. The membrane may be circular or have any other shape.

While the above description contains many specifics, these should not be construed as limitations on the scope, but rather as an exemplification of several embodiments thereof. Many other variants are possible including, for examples: the mechanical designs of the membrane, blind and shutters, the design and layout of the apertures in the membrane, blind and shutters, the materials used, the details of the stimulus signals, the actual vibration characteristics of the membrane, and shutters, the method of causing the vibration of the membrane and shutters, the flexing shapes of the membrane and shutters. Accordingly the scope should be determined not by the embodiments illustrated, but by the claims and their legal equivalents.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope.

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

Any reference to any of the terms "comprise", "comprises", "comprising" "including", "may include" and "includes" may be applied to any of the terms "consists", "consisting", "and consisting essentially of". For example—any of method describing steps may include more steps than those illustrated in the figure, only the steps illustrated in the figure or substantially only the steps illustrate in the figure. The same applies to components of a device or system.

I claim:

1. A speaker, comprising:

a group of chambers;

a first port;

a group of membranes that are configured to oscillate within the group of chambers thereby generating a group of ultrasonic signals that comprises one or more ultrasonic signals;

a group of acoustic modulators are configured to oscillate thereby modulating the group of ultrasonic signals to provide a group of audible signals that comprises a first audible signal and a second audible signal that are out-of-phase;

wherein only one of the first and second audible signals is outputted from the speaker via the first output port and at a first direction; and a control unit that is configured to control at least one of (a) the group of membranes and (b) the group of acoustic modulators in response to an input signal that represents an input audio signal.

2. The speaker according to claim 1 wherein the group of membranes comprises one or more membranes, the group of acoustic modulators comprises one or more acoustic modulators and the group of chambers comprises one or more chambers.

3. The speaker according to claim 1, wherein the first and second audible signals are in anti-phase.

4. The speaker according to claim 1, wherein the first and second audible signals are out-of-phase by at least 30 degrees.

5. The speaker according to claim 1, wherein the speaker is a micro-electromechanical system (MEMS) speaker.

6. The speaker according to claim 1, wherein a first acoustic modulator of the group of acoustic modulators comprises a blind and a shutter; wherein the shutter is configured to oscillate in relation to the blind thereby controlling a flow of air through the blind.

7. The speaker according to claim 1, wherein a first acoustic modulator of the group of acoustic modulators comprises a shutter but does not include a blind.

8. The speaker of claim 1, wherein the control unit is configured to control the group of membranes and the group of acoustic modulators in response to the input signal.

9. The speaker of claim 1, wherein the control unit is configured to control the group of membranes in response to the input signal and to control the group of acoustic modulators regardless of the input signal that represents the input signal.

10. The speaker of claim 1, wherein the control unit is configured to control the group of acoustic modulators in response to the input signal and to control the group of membranes regardless of the input signal.

11. The speaker of claim 1, wherein the group of acoustic modulators and the group of membranes are positioned at a same plane.

12. The speaker of claim 1, wherein a first acoustic modulator of the group of acoustic modulators and a first membrane of the group of membranes are positioned at a same plane.

13. The speaker of claim 1, wherein a first acoustic modulator of the group of acoustic modulators and a first membrane of the group of membranes are positioned at different planes.

14. The speaker of claim 1, wherein a first acoustic modulator of the group of acoustic modulators and a first membrane of the group of membranes are positioned at a same plane; and wherein a second acoustic modulator of the group of acoustic modulators and a second membrane of the group of membranes are positioned at different planes.

15. The speaker of claim 1, comprising a second port, wherein the speaker is configured to output the first audible signal via the first port while outputting the second audible signal via the second port at a second direction that differs from the first direction.

16. The speaker of claim 15, wherein the first and second directions are opposite to each other.

17. The speaker of claim 15, wherein the first and second directions are oriented to each other by an angle that ranges between 60 and 300 degrees.

18. The speaker of claim 1, wherein the speaker is configured to output the first audible signal via the first port while directing the second audible signal into an internal space of the speaker.

19. The speaker according to claim 1, wherein a first acoustic modulator of the group of acoustic modulators comprises a single shutter.

20. The speaker according to claim 1 comprising a second port; wherein the group of membranes comprises a first membrane and wherein the group of chambers comprises a first chamber that at least partially surrounds the first membrane; wherein the group of acoustic modulators comprises a first shutter, a second shutter, a first blind and a second blind; wherein the first and second shutter are configured to oscillate out-of-phase; wherein the speaker is configured to output the first audible signal from the first port at the first direction; and wherein the second audio signal propagates through the second port.

21. The speaker according to claim 20 wherein the second port is preceded by a conduit that is configured to prevent the second audio signal from being outputted at the first direction.

22. The speaker according to claim 20 wherein the first and second shutters are positioned at different planes.

23. The speaker according to claim 20 wherein the first and second shutters are positioned at the same plane.

24. The speaker according to claim 20, wherein the first membrane is fully surrounded by the first chamber.

25. The speaker according to claim 20, wherein the first membrane is only partially surrounded by the first chamber.

26. The speaker according to claim 1 comprising an additional port, wherein the group of chambers comprises a first chamber and a second chamber, wherein the first membrane is configured to oscillate between the first chamber and the second chamber to provide a first ultrasonic signal of the group of ultrasonic signals, wherein the first and second shutter are configured to oscillate out-of-phase thereby providing the first audible signal and the second audible signal; wherein the first audible signal is outputted from the first chamber via the first port at the first direction and wherein the second audible signal is outputted, from the second chamber via the additional port at a second direction.

27. The speaker according to claim 26, comprising a second port and a third port; wherein the first and third ports are opposite to the second and additional ports.

28. The speaker according to claim 27, wherein the first shutter is configured to oscillate between (a) a first position in which the first shutter facilitates a passage of the first audible signal towards the first port while preventing the propagation of the first audible signal towards the second port and (b) a second position in which the first shutter facilitates a propagation of the first audible signal towards the second port while preventing the propagation of the first audible signal towards the first port.

29. The speaker according to claim 26 wherein the membrane, the first shutter and the second shutter are positioned at a same plane.

30. The speaker according to claim 1 comprising a second port, a third port and a fourth port; wherein the group of chambers comprises a first chamber, a second chamber and a third chamber; wherein the group of membranes comprises a first membrane and a second membrane; wherein the group of acoustic modulators comprises a first shutter, a second shutter, a third shutter and a fourth shutter; wherein the first and second membranes are configured to oscillate out-of-phase thereby generating a first ultrasonic signal of the group of ultrasonic signals; wherein the first membrane oscillates between the first and second chambers; wherein the second membrane oscillates between the second and third chambers; wherein the first and fourth shutters are configured to oscillate out-of-phase in relation to the second and third shutters thereby modulating the first ultrasonic signal and to output the first audible signal from the first chamber and via the first port at the first direction and to output the second audible signal from the third chamber and via the fourth port at a second direction.

31. The speaker according to claim 30, wherein the first, second, third and fourth shutters are positioned at a same plane.

32. The speaker according to claim 30, wherein the third shutter is configured to input air via the third port and into the first chamber and wherein the fourth shutter is configured to input air via the fourth ports.

33. The speaker according to claim 30, wherein the first and second ports are opposite to the third and fourth ports.

34. The speaker according to claim 30, wherein at least two shutter of the first, second, third and fourth shutters are positioned at different planes.

35. A method for activating a speaker, the method comprising:

oscillating a group of membranes within a group of chambers of the speaker thereby generating a group of ultrasonic signals that comprises one or more ultrasonic signals;

oscillating a group of acoustic modulators of the speakers thereby modulating the group of ultrasonic signals to provide a group of audible signals that comprises a first audible signal and a second audible signal that are out-of-phase;

outputting only one of the first and second audible signals from the speaker via the first output port and at a first direction; and controlling, by a control unit, at least one of (a) the group of membranes and (b) the group of acoustic modulators in response to an input signal that represents an input audio signal.

* * * * *